US008826818B2

(12) United States Patent
Puig Vilá

(10) Patent No.: US 8,826,818 B2
(45) Date of Patent: Sep. 9, 2014

(54) SCRAPER DEVICE FOR A PRINTING MACHINE

(75) Inventor: Jordi Puig Vilá, Bescanó (ES)

(73) Assignee: Comexi Group Industries, S.A. (ES)

( * ) Notice: Subject to any disclaimer, the term of this patent is extended or adjusted under 35 U.S.C. 154(b) by 15 days.

(21) Appl. No.: 13/701,098

(22) PCT Filed: Jun. 1, 2011

(86) PCT No.: PCT/ES2011/000176

§ 371 (c)(1),
(2), (4) Date: Mar. 6, 2013

(87) PCT Pub. No.: WO2011/151486

PCT Pub. Date: Dec. 8, 2011

(65) Prior Publication Data

US 2013/0174751 A1 Jul. 11, 2013

(30) Foreign Application Priority Data

Jun. 1, 2010 (ES) ..... 201000745

(51) Int. Cl.

| | |
|---|---|
| ***B41F 9/10*** | (2006.01) |
| ***B41F 31/00*** | (2006.01) |
| ***B41F 31/05*** | (2006.01) |
| ***B41F 31/02*** | (2006.01) |

(52) U.S. Cl.

CPC ..... *B41F 31/05* (2013.01); *B41F 31/027* (2013.01)

USPC ..... 101/169; 101/350.6; 101/157

(58) Field of Classification Search

USPC ..... 101/157, 169, 350.06, 366, 350.6; 15/236.05, 236.06; 118/261, 410, 413

See application file for complete search history.

(56) References Cited

U.S. PATENT DOCUMENTS

| | | | | |
|---|---|---|---|---|
| 3,168,294 | A | 2/1965 | Hasumura | |
| 4,821,672 | A * | 4/1989 | Bruno | 118/261 |
| 5,150,651 | A * | 9/1992 | Flores | 101/207 |
| 5,406,887 | A * | 4/1995 | Hertel et al. | 101/366 |
| 5,549,382 | A | 8/1996 | Correia, II et al. | |
| 5,834,739 | A | 11/1998 | Lockwood et al. | |
| 2002/0083857 | A1 * | 7/2002 | Bardet et al. | 101/480 |
| 2009/0266256 | A1 * | 10/2009 | Rothlein et al. | 101/366 |

FOREIGN PATENT DOCUMENTS

| | | | |
|---|---|---|---|
| DE | 19624648 | A1 | 1/1998 |
| EP | 1238612 | A1 | 11/2002 |
| JP | 59073034 | A | 4/1984 |
| JP | 2005296423 | A | 10/2005 |
| WO | 02096761 | A2 | 12/2002 |
| WO | 2005110587 | A2 | 11/2005 |

* cited by examiner

*Primary Examiner* — Ren Yan

(74) *Attorney, Agent, or Firm* — Hess Patent Law Firm LLC; Robert J. Hess

(57) ABSTRACT

The present invention relates to a scraper device for a printing machine which comprises a scraper body (20) having longitudinal blades (2) and lateral sealing elements, and having ink inlet and outlet passages (24). The scraper body (20) is supported by a scraper support (10) adjacent to an inking roller of a printing machine, and having ink supply and discharge passages (11) connected to respective ink supply and discharge conduits of an ink circulation device. Positioning and fixing means allow fixing the scraper body (20) to the scraper support (10) in an operating position in which openings (24*a*) of said ink inlet and outlet passages (24) of the scraper body (20) are in fluid communication with openings (11*a*) of said ink supply and discharge passages (11) of the scraper support (10).

10 Claims, 6 Drawing Sheets

SCRAPER DEVICE FOR A PRINTING MACHINE

FIELD OF THE ART

The present invention relates to a scraper device for a printing machine which comprises an assembly formed by a scraper body, blades and lateral sealing elements which can be installed in and removed from a chamber support without needing to connect and disconnect the ink supply and discharge conduits of an ink circulation device.

BACKGROUND OF THE INVENTION

Some printing machines, and especially flexographic printing machines, comprise several print groups, each of which includes an ink application device for applying ink to an inking or anilox roller. This ink application device comprises a scraper device including an ink chamber demarcated by blades and lateral sealing elements which are in dynamic contact with the mentioned inking roller. The ink chamber is connected to an ink circulation device by means of ink supply and discharge conduits and corresponding connectors. A drawback of scraper devices is that to perform the cleaning and maintaining tasks on the chamber, blades and other elements of the device, which tasks can be frequent due to the usual requirements for changing ink color, it is necessary to remove and re-install a scraper body supporting the blades and the lateral sealing elements, and this makes it necessary to disconnect and re-connect the ink supply and discharge conduits from/to the corresponding connectors, with a considerable time loss.

DISCLOSURE OF THE INVENTION

The present invention provides a scraper device for a printing machine which can be removed and re-installed without needing to disconnect and re-connect the ink supply and discharge conduits. To that end, the scraper device comprises a scraper support adjacent to an inking roller of a printing machine and a scraper body supported by said scraper support. The scraper body is elongated in a longitudinal direction parallel to the axis of rotation of the inking roller, and has a chamber surface extending along same and blade supports located on transversely opposite sides of the chamber surface, where respective longitudinal blades are fixed. Each of said blades has a cantilever portion ending in an edge arranged to make dynamic contact with the inking roller. The scraper body also has lateral sealing supports located at longitudinally opposite ends of the chamber surface, and in which there are installed lateral sealing elements configured for making elastic sealing contact with the blades and dynamic sealing contact with the inking roller.

Ink inlet and outlet passages which have respective openings in the chamber surface of the scraper body are formed through the scraper body. The scraper support comprises ink supply and discharge passages connected to respective ink supply and discharge conduits of an ink circulation device. Positioning and fixing means comprising respective complementary positioning elements and fixing screws and threaded holes associated with the scraper body and with the scraper support allow fixing the scraper body to the scraper support in an operating position in which the openings of said ink inlet and outlet passages of the scraper body are in fluid communication with openings of the ink supply and discharge passages of the scraper support.

With this arrangement, the scraper body with the blades and the lateral sealing elements can be removed from the chamber support and re-installed establishing fluid communication with the ink circulation device without needing to disconnect and re-connect the ink supply and discharge conduits since they stay connected to the respective passages of the scraper support. In one embodiment, the scraper support is supported by a bedplate of the printing machine such that it can rotate about an axis parallel to the longitudinal direction of the scraper body between a working position and a maintenance position, and the positioning and fixing means comprise first positioning elements installed in the scraper support and second positioning elements installed in the scraper body allowing a mutual linear sliding coupling in a direction perpendicular to the longitudinal direction.

BRIEF DESCRIPTION OF THE DRAWINGS

The foregoing and other features and advantages will be better understood from the following detailed description of an embodiment in reference to the attached drawings, in which.

DETAILED DESCRIPTION OF AN EMBODIMENT

Figure 1:
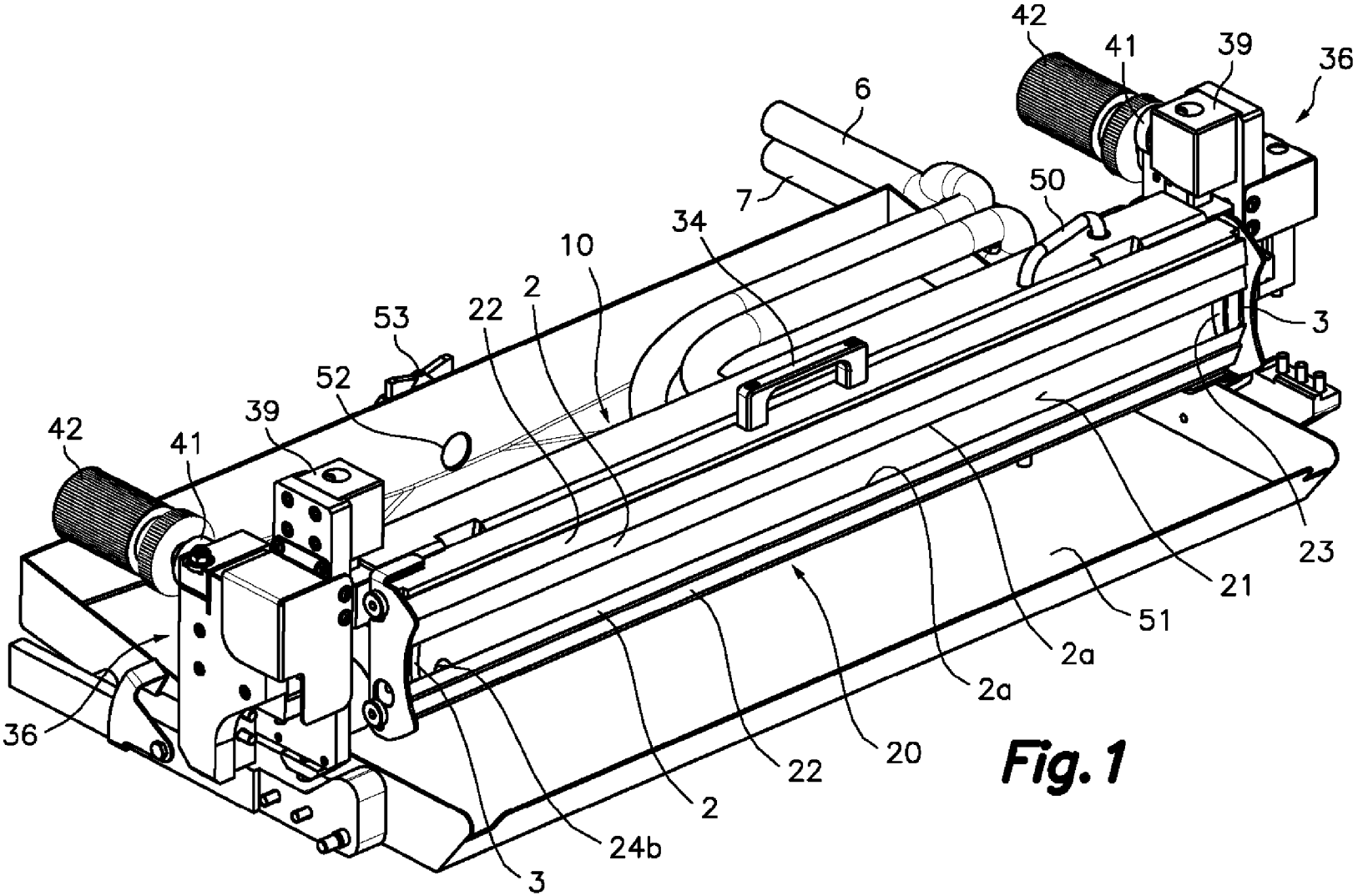
FIG. 1 is a perspective view showing a front side of a scraper device for a printing machine according to an embodiment of the present invention in a working position.
Figure 2:
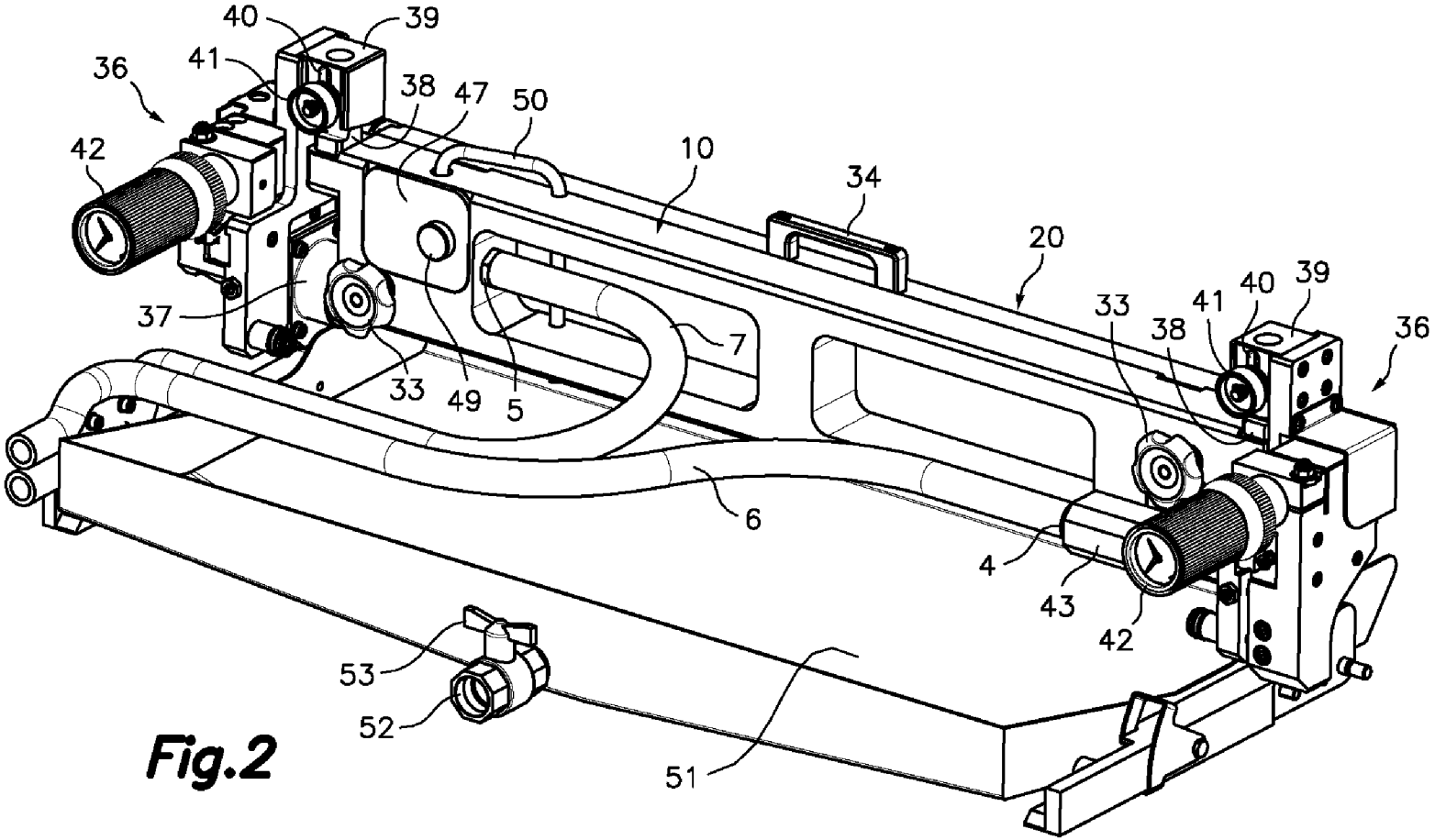
FIG. 2 is a perspective view showing a rear side of the scraper device of FIG. 1 in the working position.

In reference to the drawings, according to an embodiment of the present invention, the scraper device for a printing machine comprises a scraper support 10 adjacent to an inking roller (not shown) of a printing machine and a scraper body 20 supported by said scraper support 10. The scraper body 20 is elongated in a longitudinal direction parallel to the axis of said inking roller and has a chamber surface 21 (FIG. 1) extending along same. On transversely opposite sides of said chamber surface 21 of the scraper body 20 there are conventional blade supports 22 in which there are fixed respective longitudinal blades 2, each of which has a cantilever portion ending in an edge 2*a* arranged, when the scraper device is in a working position, for making dynamic contact with the inking roller while it rotates.

At longitudinally opposite ends of the chamber surface 21 of the scraper body 20 there are conventional lateral sealing supports 23 in which there are installed lateral sealing elements 3 configured for making an elastic sealing contact with the blades 2 and a dynamic sealing contact with the inking roller along a separation between the blades 2. Therefore, in operation, the chamber surface 21, the blades 2, the lateral sealing elements 3 and a portion of the surface of the inking roller form an ink chamber, which is in communication with an ink circulation device, as will be described below, for applying ink to the surface of the inking roller as it rotates.

Figure 6:
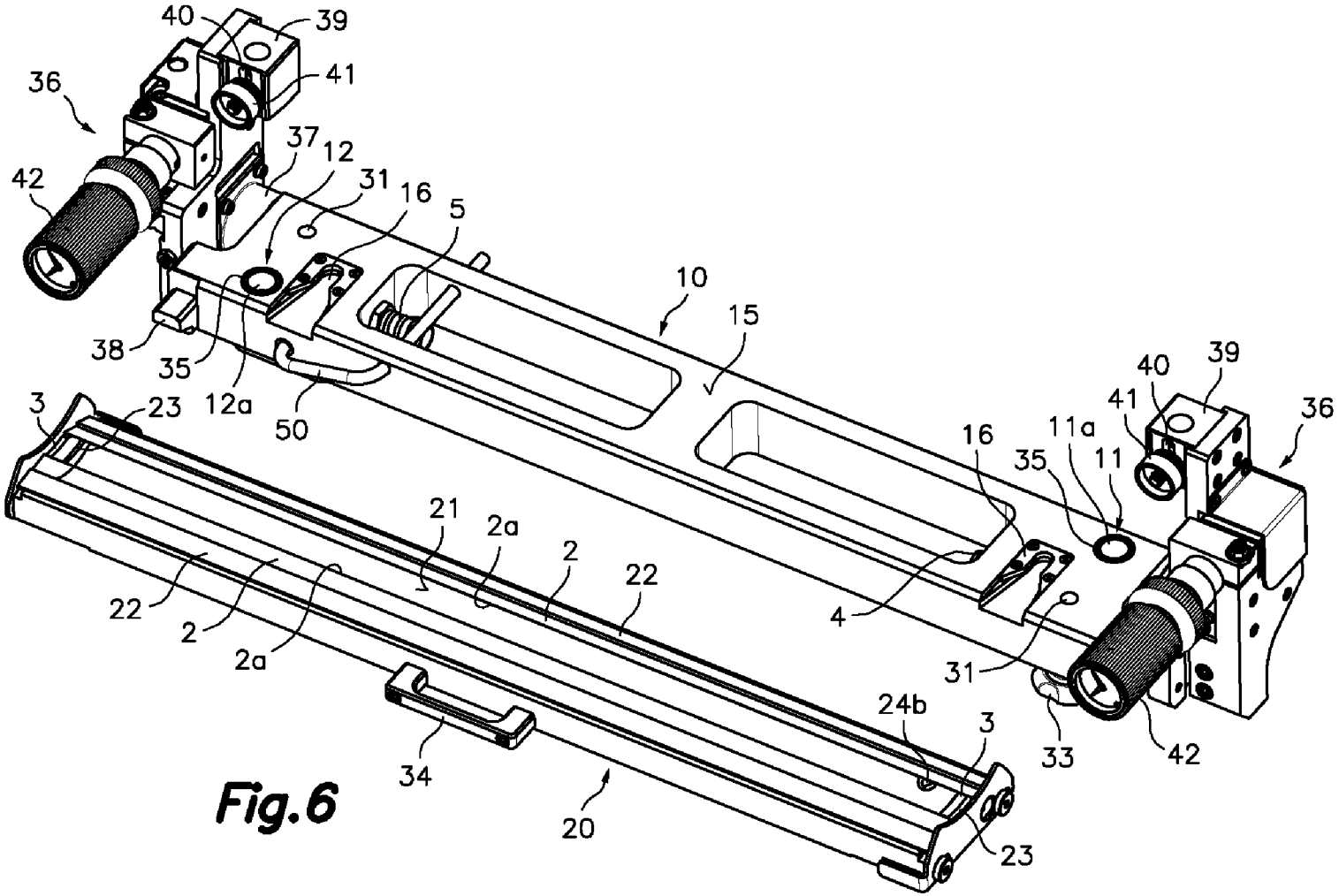
FIG. 6 is a perspective view of the scraper device in the maintenance position and with the scraper body separated from the scraper support.
Figure 7:
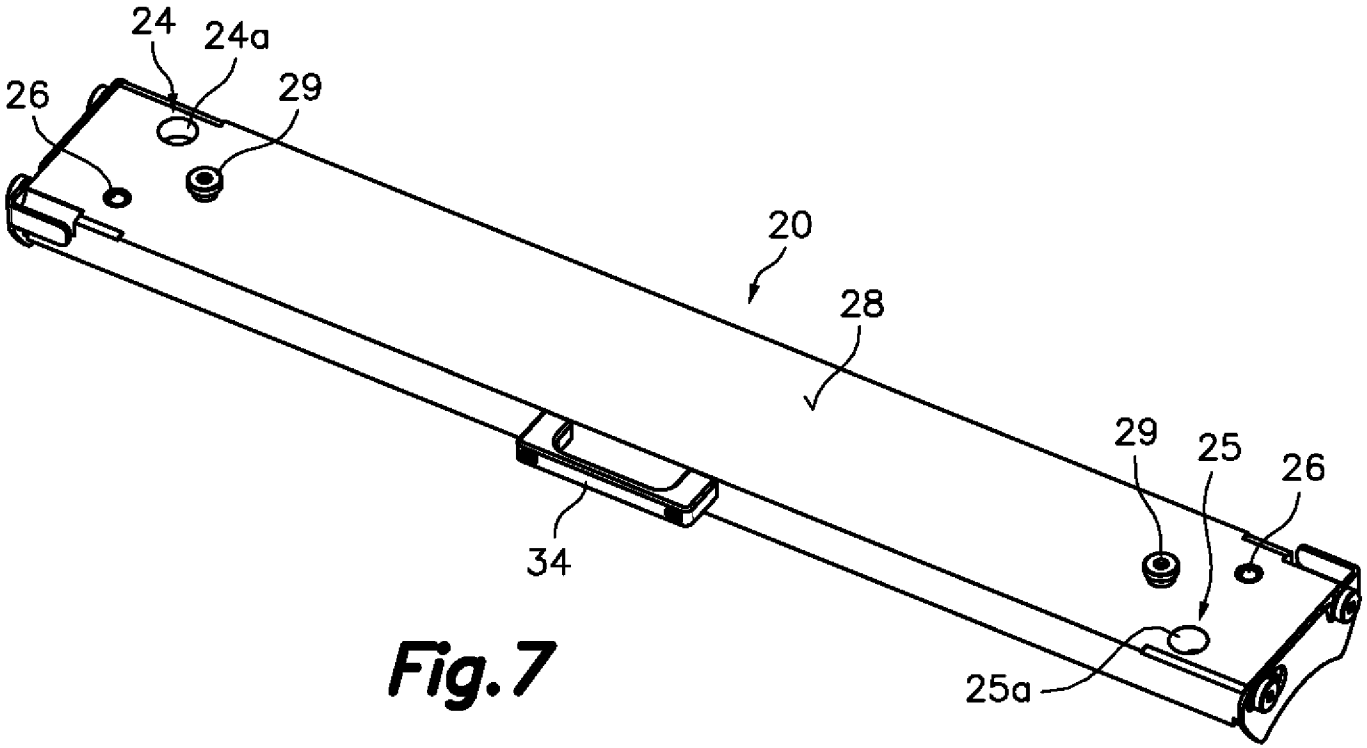
FIG. 7 is a perspective view of the scraper body showing a rear side of the body.

The scraper support 10 comprises in its front part a support surface 15 (FIGS. 6 and 7) on which there are installed first positioning elements 16 by way of tracks with a slot narrower than a bottom channel and a beveled inlet at one end, and the scraper body 20 has in its rear part a coupling surface 28 (FIG. 7) on which there are installed second positioning elements 29 by way of projections with a head larger than a connecting rod. The mentioned first and second positioning elements 16, 29 are mated elements such that they allow mutual coupling and uncoupling by a linear sliding movement in a direction perpendicular to the longitudinal direction of the scraper body 20. A handle 34 fixed in the scraper body 20 allows a comfortable grip for handling same.

The first and second positioning elements 16, 29 form part of positioning and fixing means which further include fixing screws 31 inserted through through holes 13 formed in the scraper support 10 and corresponding threaded holes 26 formed in the coupling surface 28 of the scraper body 20. Each fixing screw 31 has, fixed at its rear end, an accessible knob 33 on the rear side of the scraper support 10. When the scraper body 20 is positioned in an operating position with respect to the scraper support 10 by virtue of the first and second positioning elements 16, 29, the coupling surface 28 is attached to the support surface 15 and the fixing screws 31 are aligned with the threaded holes 26, such that the fixing screws 31 can be screwed into the threaded holes 26 using the knobs 33. Preferably, to prevent errors, the positioning and fixing means are configured such that the scraper body 20 can only be fixed to the scraper support 10 in a single position.

Figure 4:
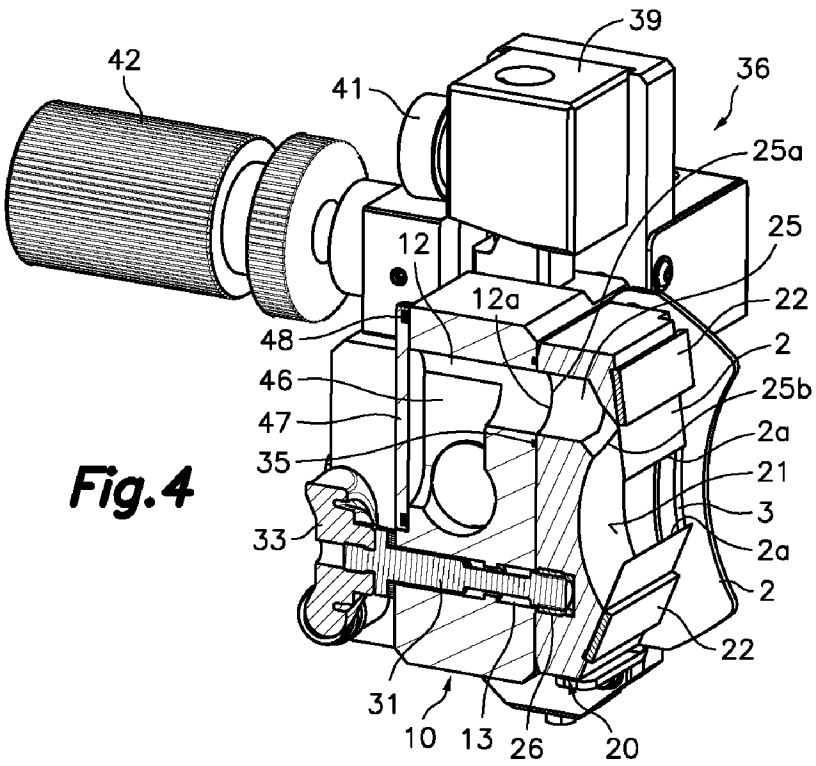
FIG. 4 is a sectioned perspective view of the scraper device in the working position showing the ink outlet passage.
Figure 3:
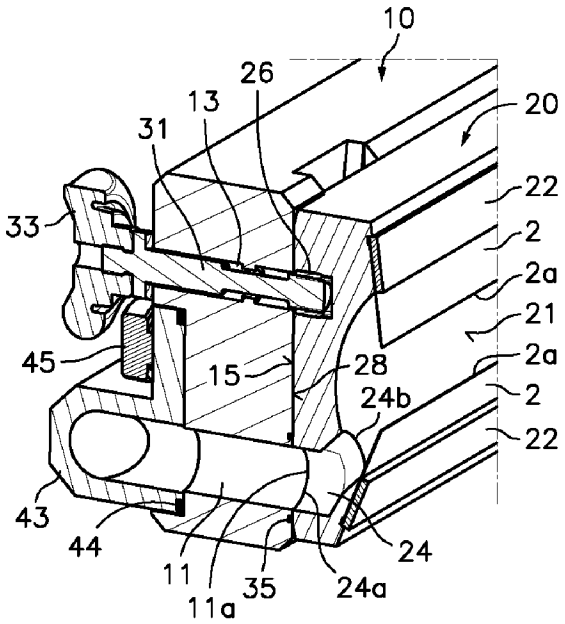
FIG. 3 is a sectioned perspective view of the scraper device of FIG. 1 in the working position showing the ink inlet passage.

An ink inlet passage 24 and an ink outlet passage 25 are formed through the scraper body 20, said passages being located in corners diagonally opposite same. The ink inlet passage 24 (best shown in FIG. 3) has a first opening 24*a* on the coupling surface 28 at one end and a second opening 24*b* on the chamber surface 21 at the other opposite end. The ink outlet passage 25 (best shown in FIG. 4) has a first opening on the coupling surface 28 at one end and a second opening 25*a* on the chamber surface 21 at the other opposite end. Alternatively, several ink inlet passages 24 and/or several ink outlet passages 25 may be formed through the scraper body 20 with a similar result.

The scraper support 10 comprises an ink supply passage 11 and an ink discharge passage 12. The ink supply passage 11 (best shown in FIG. 3) has a first opening 11*a* on the support surface 15 at one end and is connected to an input connector 4 for connecting with an ink supply conduit 6 at the other opposite end. The ink discharge passage 12 (best shown in FIG. 4) has a first opening 12*a* on the support surface 15 at one end and is connected to an output connector 5 for connecting with an ink discharge conduit 7 at the other opposite end.

When the scraper body 20 is positioned in an operating position with respect to the scraper support 10 by virtue of the first and second positioning elements 16, 29, the first and second openings 24*a*, 25*a* of the ink inlet and outlet passages 24, 25 of the scraper body 20 are facing and in fluid communication with the first openings 11*a*, 12*a* of the ink supply and discharge passages 11, 12 of the scraper support 10. Around the first openings 11*a*, 12*a* of the ink supply and discharge passages 11, 12 on the support surface 15 of the scraper support 10 there are formed annular channels in which there are arranged respective sealing rings 35, which are pressed by the coupling surface 28 of the scraper body 20 when the fixing screws 31 are screwed into the threaded holes 26.

The mentioned ink supply and discharge conduits 6, 7 are connected to a conventional ink circulation device (not shown), such that when the scraper device is in the working position the ink is circulated through the ink chamber to be smeared on the inking roller with the help of blades 2. By rotating the knobs 33 to loosen the fixing screws 31 and pulling the handle 34, the assembly formed by the scraper body 10, the blades 2 and the lateral sealing elements 3 can be removed without needing to uncouple the ink supply and discharge conduits 6, 7. By means of the opposite operations the assembly formed by the scraper body 10, the blades 2 and the lateral sealing elements 3 can be installed automatically establishing fluid communication with the ink circulation device without needing to couple the ink supply and discharge conduits 6, 7.

Figure 5:
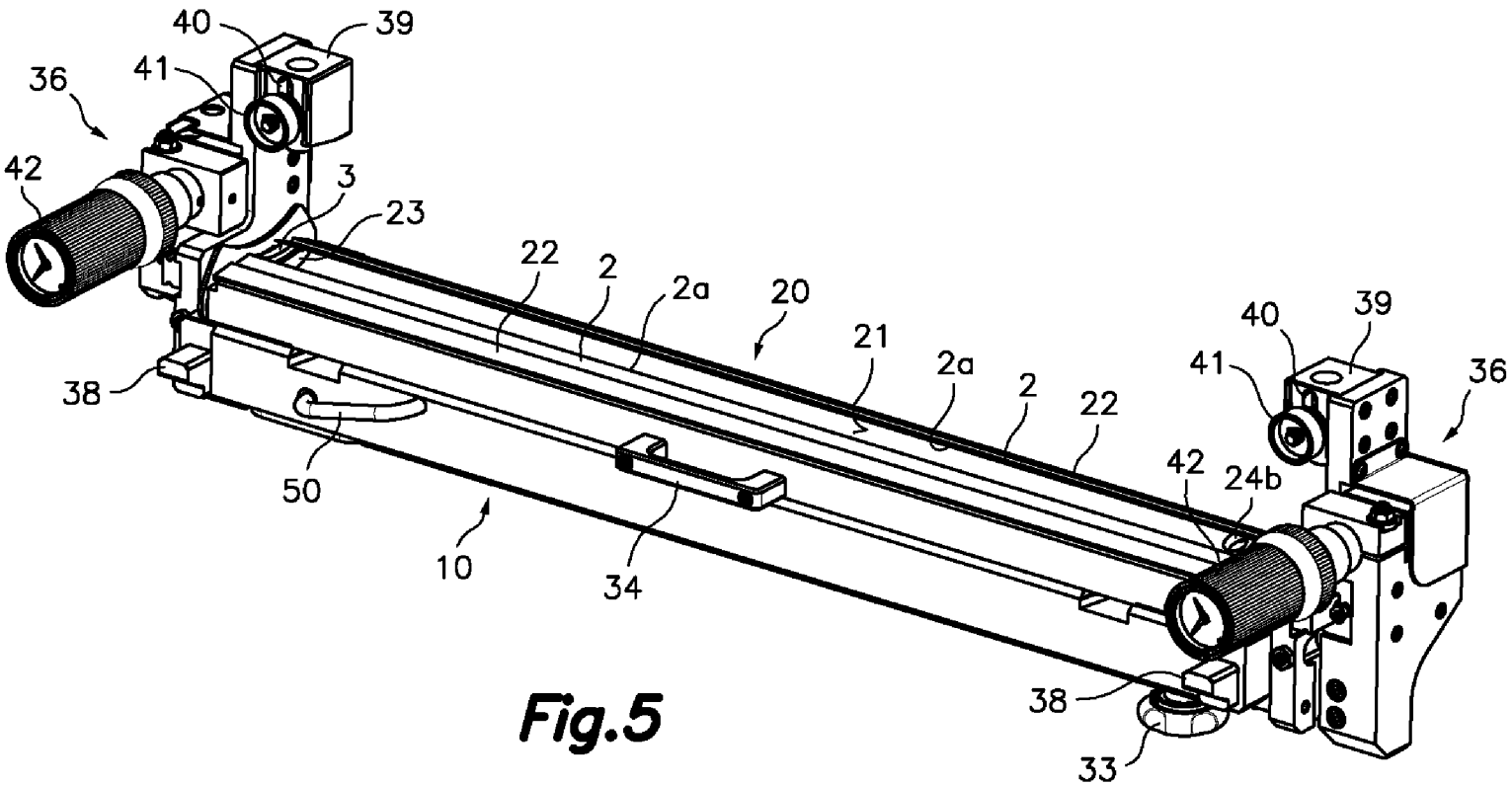
FIG. 5 is a perspective view showing the scraper device in the maintenance position.

For greater comfort, the scraper support 10 is supported by support assemblies 36 fixed to a bedplate of the printing machine (not shown) by means of an articulation device 37, such that the scraper support 10 can rotate about an axis parallel to the longitudinal direction between a working position (FIGS. 1 to 4) in which the support surface 15 is substantially vertical, and a maintenance position (FIGS. 5 and 6) in which the support surface 15 is substantially horizontal. The ink supply and discharge conduits 6, 7 are flexible conduits allowing the rotation of the scraper support 10 between said working and maintenance positions by bending same.

Retention projections 38 protrude from the scraper support 10, which projections, when the scraper device is in the working position, are retained by corresponding retention elements installed such that they can slide vertically between a lower locking position and an upper release position within guiding blocks 39 installed in the support assemblies 36. Screws passing through the elongated holes 40 of the guiding blocks 39 can be tightened by means of knobs 41 to immobilize the retention elements in the locking position. For a fine tuning, the assembly formed by the scraper support 10 and the scraper body 20 can be moved in a substantially horizontal direction perpendicular to the longitudinal direction by means of micrometric screws operated by corresponding knobs 42.

For structural reasons, in the embodiment illustrated the ink supply passage 11 of the scraper body 20 comprises an elbow formed in an additional part 43 (best shown in FIG. 3) fixed to the scraper body 20 by means of a screw 45 and sealed by means of a sealing cord 44. The ink discharge passage 12 comprises a mortise 46 formed in the scraper body 20 and closed by a cover 47 fixed to the scraper body 20 by means of a screw 49 (FIG. 2) and sealed by means of a sealing cord 48. The mortise 46 and cover 47 form a small chamber communicated with the atmosphere by a tube 50. Therefore, the circuit of the ink circulation device works at atmospheric pressure, and any excess of ink is discharged through the tube 50 and collected in a tray 51 (FIGS. 1 and 2), which has a drainage outlet 52 controlled by a cock 53.

It will be observed that the scraper support 10 of the scraper device of the present invention performs two functions: as a swiveling support for the scraper body 20; and as an ink conduit by virtue of the ink supply and discharge passages 11, 12 permanently connected to the ink supply and discharge conduits 6, 7 by means of the connectors 4, 5.

A person skilled in the art will be able to introduce modifications and variations based on the embodiments shown and described without departing from the scope of the invention as defined in the attached claims.

The invention claimed is:

1. A scraper device for a printing machine, the scraper device comprising:

a scraper support adjacent to an inking roller of a printing machine;

a scraper body elongated in a longitudinal direction parallel to an axis of said inking roller, supported by said scraper support, said scraper body having a chamber surface extending along same;

longitudinal blades fixed to the scraper body on transversely opposite sides of said chamber surface;

lateral sealing elements installed in the scraper body at longitudinally opposite ends of the chamber surface; and at least one ink inlet passage and at least one ink outlet passage formed through the scraper body, open in said chamber surface and arranged for being connected to an ink circulation device, wherein the scraper support comprises an ink supply passage and an ink discharge passage connected to respective ink supply and discharge conduits of said ink circulation device, and positioning and fixing means are arranged for removably fixing the scraper body to the scraper support in an operating position in which openings of said ink inlet and outlet passages of the scraper body are in fluid communication with openings of said ink supply and discharge passages of the scraper support;

and wherein the scraper support comprises a support surface that is substantially vertical in a working position on which said openings of the ink supply and discharge passages are formed, said support surface being configured for being coupled to a coupling surface of the scraper body in which said openings of the ink inlet and outlet passages are formed when the scraper body is fixed to the scraper support in the operating position; and wherein said positioning and fixing means comprise first positioning elements by way of guides installed in the scraper support and second positioning elements by way of projections installed in the scraper body, said first and second positioning elements being mated elements providing a mutual linear coupling and uncoupling by a linear sliding movement in a direction perpendicular to said longitudinal direction and parallel to said support surface of the scraper support.

2. The device according to claim 1, wherein the positioning and fixing means further comprise fixing screws and corresponding threaded holes for fixing the scraper body to the scraper support.

3. The device according to claim 2, wherein the positioning and fixing means are configured such that the scraper body can only be fixed to the scraper support in a single position.

4. The device according to claim 1, wherein the positioning and fixing means are configured such that the scraper body can only be fixed to the scraper support in a single position.

5. The device according to claim 1, wherein the scraper support is supported by a bedplate of the printing machine such that it can rotate about an axis parallel to the longitudinal direction between a working position and a maintenance position.

6. The device according to claim 5, wherein the support surface is substantially horizontal in said maintenance position.

7. The device according to claim 6, wherein said mutual linear sliding coupling between said scraper support and the scraper body in said maintenance position is performed in a substantially horizontal direction.

8. The device according to claim 5, wherein said mutual linear sliding coupling between said scraper support and the scraper body in said maintenance position is performed in a substantially horizontal direction.

9. The device according to claim 5, wherein the mentioned ink supply and discharge conduits of the ink circulation device are flexible conduits to allow the rotation of the scraper support between said working and maintenance positions by bending same.

10. The device according to claim 1, wherein the ink supply passage of the scraper support is connected to an input connector for connecting with said ink supply conduit and the ink discharge passage of the scraper support is connected to an output connector for connecting with said ink discharge conduit.

* * * * *